United States Patent [19]

Neyenhouse

[11] 4,440,145

[45] Apr. 3, 1984

[54] WET-BASED, WOOD-BURNING BOILER

[76] Inventor: Peter A. Neyenhouse, Rte. 2, Box 322B, Morrisonville, N.Y. 12962

[21] Appl. No.: 482,878

[22] Filed: Apr. 7, 1983

[51] Int. Cl.[3] ..... F24C 1/14

[52] U.S. Cl. ..... 126/61; 126/285 A; 126/297

[58] Field of Search ..... 122/2, 15, 22; 126/132, 126/285 A, 285 R, 289, 292, 297, 77, 67, 61

[56] References Cited

U.S. PATENT DOCUMENTS

| | | | |
|---|---|---|---|
| 567,034 | 9/1896 | Loy | 126/61 |
| 1,305,764 | 6/1919 | Alwart | 126/77 |
| 2,559,271 | 7/1951 | Baines | 126/77 |
| 4,154,212 | 5/1979 | Wilkinson | 126/77 |
| 4,192,285 | 3/1980 | Nietupski | 126/83 |
| 4,232,653 | 11/1980 | Otterpohl | 126/77 |
| 4,303,198 | 12/1981 | Dulac | 122/15 |
| 4,320,738 | 3/1982 | Johnson | 126/77 |
| 4,355,624 | 10/1982 | Hardin | 126/285 A |

*Primary Examiner*—Larry Jones
*Assistant Examiner*—G. Anderson
*Attorney, Agent, or Firm*—Walter F. Wessendorf, Jr.

[57] ABSTRACT

Disclosed is a wet-based, wood-burning boiler that has a combustion chamber that heats water in a cylindrical main boiler chamber and in a communicating rear boiler chamber. A flue directly exhausts smoke, flue gases and products of combustion from the combustion chamber without creosote formation, while a damper plate, tracked to its closed position: indirectly exhausts without lowering the temperature of the exhausting flue gases to creosote deposition temperature because the damper plate structure has a more effective draft area than the flue draft area, while at the same time the damper plate structure retains the highest temperature possible in the combustion chamber, and traps and transfers heat to the water in the boiler chambers more quickly and with a faster recovery rate.

The wet-based, wood-burning boiler can be converted to a wood-burning, forced, hot-air furnace while retaining its tracked damper plate structure and functional attributes associated therewith.

In another embodiment, the wet-based, wood-burning boiler can be modified to function as a radiant heater while retaining its tracked damper plate structure and functional attributes associated therewith.

8 Claims, 11 Drawing Figures

WET-BASED, WOOD-BURNING BOILER

BACKGROUND OF THE INVENTION

1. Technical Field

This invention relates to a wet-based, wood-burning boiler.

2. Background Art

The prior art, U.S. Pat. No. 567,034, discloses heating stove; U.S. Pat. No. 1,305,764 discloses a means for converting base burner stoves into soft coal heaters; U.S. Pat. No. 2,559,271 discloses a fireplace with movable reflector; U.S. Pat. No. 4,154,212 discloses a fuel burning heater; U.S. Pat. No. 4,192,285 discloses an air tight fuel burning stove; and U.S. Pat. No. 4,320,738 discloses a heating stove.

When wood burns, a mixture of combustible gases, water vapor and carbon dioxide leave the fire as flue gas. Excellent combustion (complete burning) produces a flue gas composed almost entirely of water vapor and carbon dioxide. A very hot fire, supported by sufficient oxygen, approaches complete combustion.

There are three stages of combustion. In the first stage, the wood is heated to evaporate and drive off moisture in the wood. This heat does not warm the boiler, stove, room or chimney. In the second stage, the wood starts to break down chemically at 500° F. and volatile matter is vaporized. These vapors contain 50–60% of the heat value of the wood. If the temperature reaches 1100° F. and oxygen is added, these vapors will burn. In the third stage, following the release of the volatile gases, the remaining material is charcoal, which burns at temperatures exceeding 1100° F.

Flue gases leaving the fire cool as heat is absorbed by the smokepipe-chimney system. It flue gas temperature drops below about 270° F. at the top of the chimney, these unburned volatiles and water vapor condense. In time, the water evaporates leaving dark, highly combustible creosote on the smokepipe and chimney walls.

Creosote presents considerable danger. It is the highly combustible fuel that feeds a chimney fire. These fires produce flying embers and the intense heat can crack the tile linings, deteriorate masonry, and ruin a metal chimney. In some cases, violent vibration, caused by repeated ignition and suffocation of the burning creosote, can separate the smokepipes, and dump burning material over a large area. A fire within the chimney can also spread to house framing and endanger lives as well as property.

A factor that can affect creosote formation is the smokepipe or stovepipe. The length of the smokepipe should be kept as short as possible and always less than 10 feet. A long run of smokepipe will radiate more heat, but it will cool flue gases enough to increase creosote formation.

SUMMARY OF THE INVENTION

The object of this invention is to provide a wet-based, wood-burning boiler to heat water for the hot-water heating system to heat the home without the problem of creosote from burning wood in the combustion chamber. To contribute to the solution of this discussed problem of creosote formation, the invention structurally incorporates a unique secondary damper system means that has an open position whereby the boiler flue directly exhausts from the combustion chamber smoke, flue gases and products of combustion without creosote formation; and the secondary damper system means has a closed position whereby such smoke, flue gases and products of combustion take a serpentine path exhausting indirectly to the boiler flue without creosote formation from lowering the temperature of the exhausting flue gases to their critical creosote deposition temperature.

The secondary damper system means structurally embodies a tracked damper plate, which in its closed position affords and provides a draft area that is substantially greater than the draft area afforded and provided by the boiler flue. Accordingly, the tracked damper plate in its closed position obviates the formation of creosote.

Such tracked damper plate in its closed position further retains the highest temperature possible in the combustion chamber while at the same time trapping and transferring heat to the boiler chambers to heat boiler chamber water more quickly and with a faster recovery rate.

BRIEF DESCRIPTION OF THE DRAWINGS

This object and other objects of the invention should be discerned and appreciated by reference to the drawings, wherein like reference numerals refer to similar parts throughout the several views, in which.

DESCRIPTION OF THE PREFERRED EMBODIMENT

Figure 1:
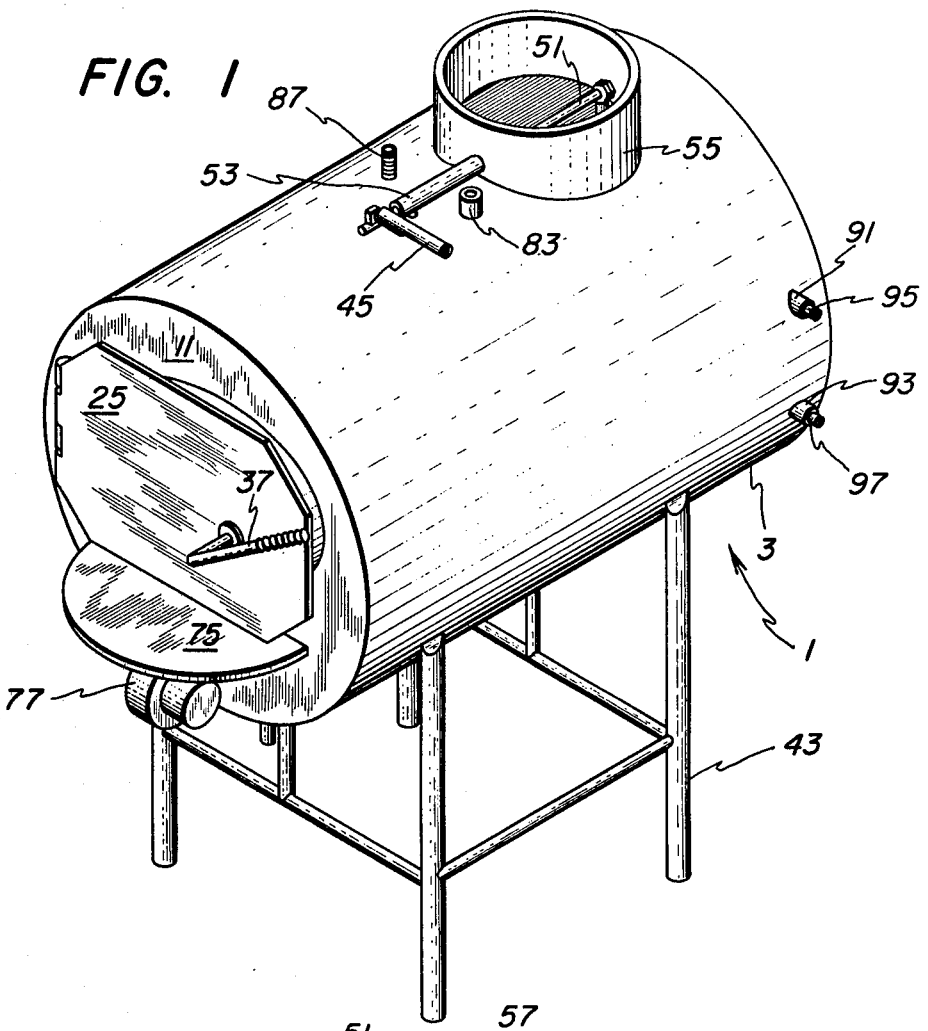
FIG. 1 is an isometric view of the wet-based, wood-burning boiler of this invention.
Figure 2:
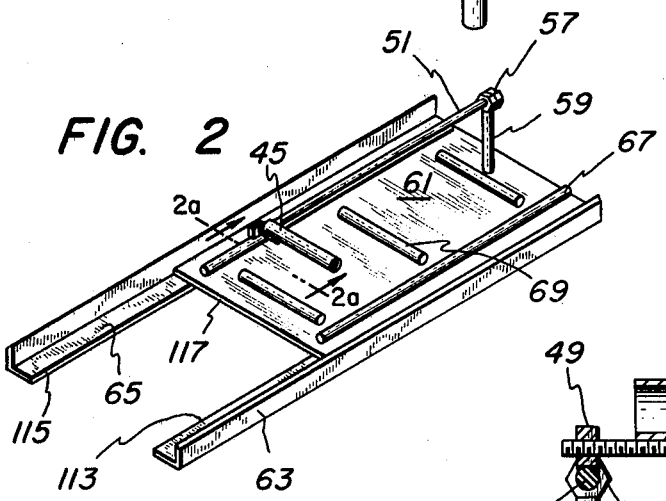
FIG. 2 is a view of the secondary damper system means.
Figure 2A:
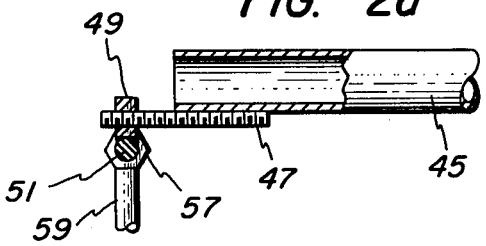
FIG. 2*a* is a view taken in the direction of the arrow 2*a* in FIG. 2.
Figure 4:
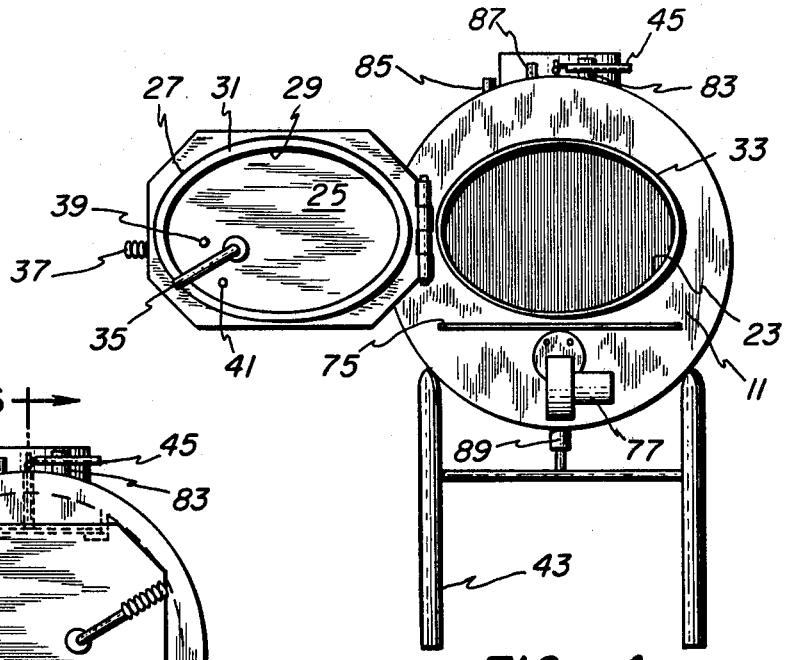
FIG. 4 is a front view of the boiler showing the feed door open and the oval opening in the front wall for access to the combustion chamber.
Figure 3:
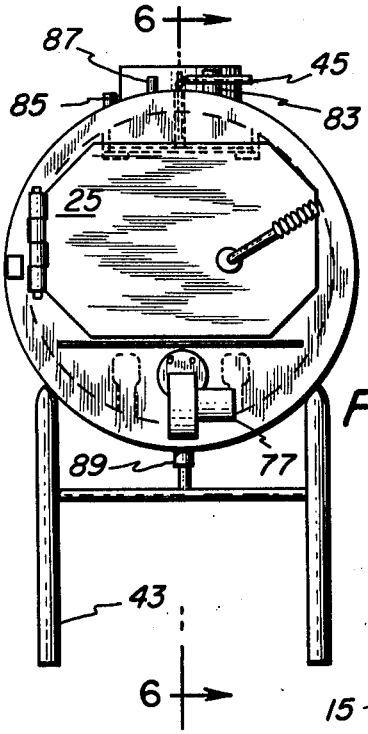
FIG. 3 is a front view of the wet-based, wood-burning boiler.
Figure 6:
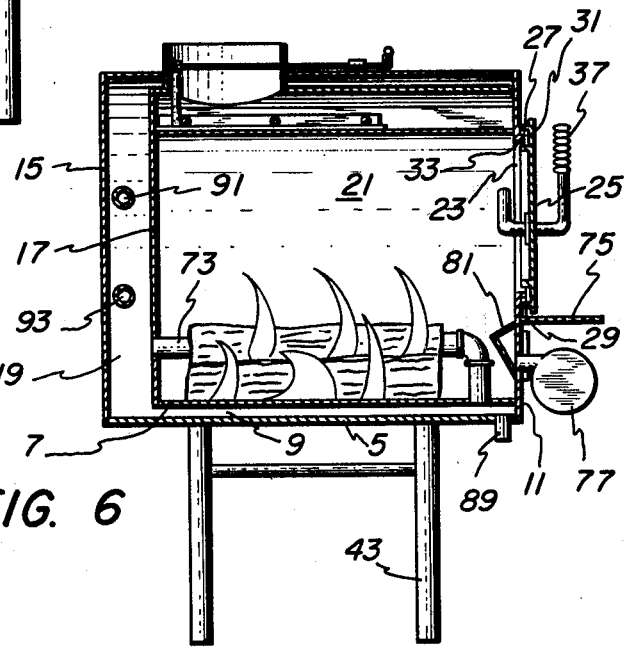
FIG. 6 is a side elevation cross-sectional view of the boiler with a fire in the combustion chamber.
Figure 5:
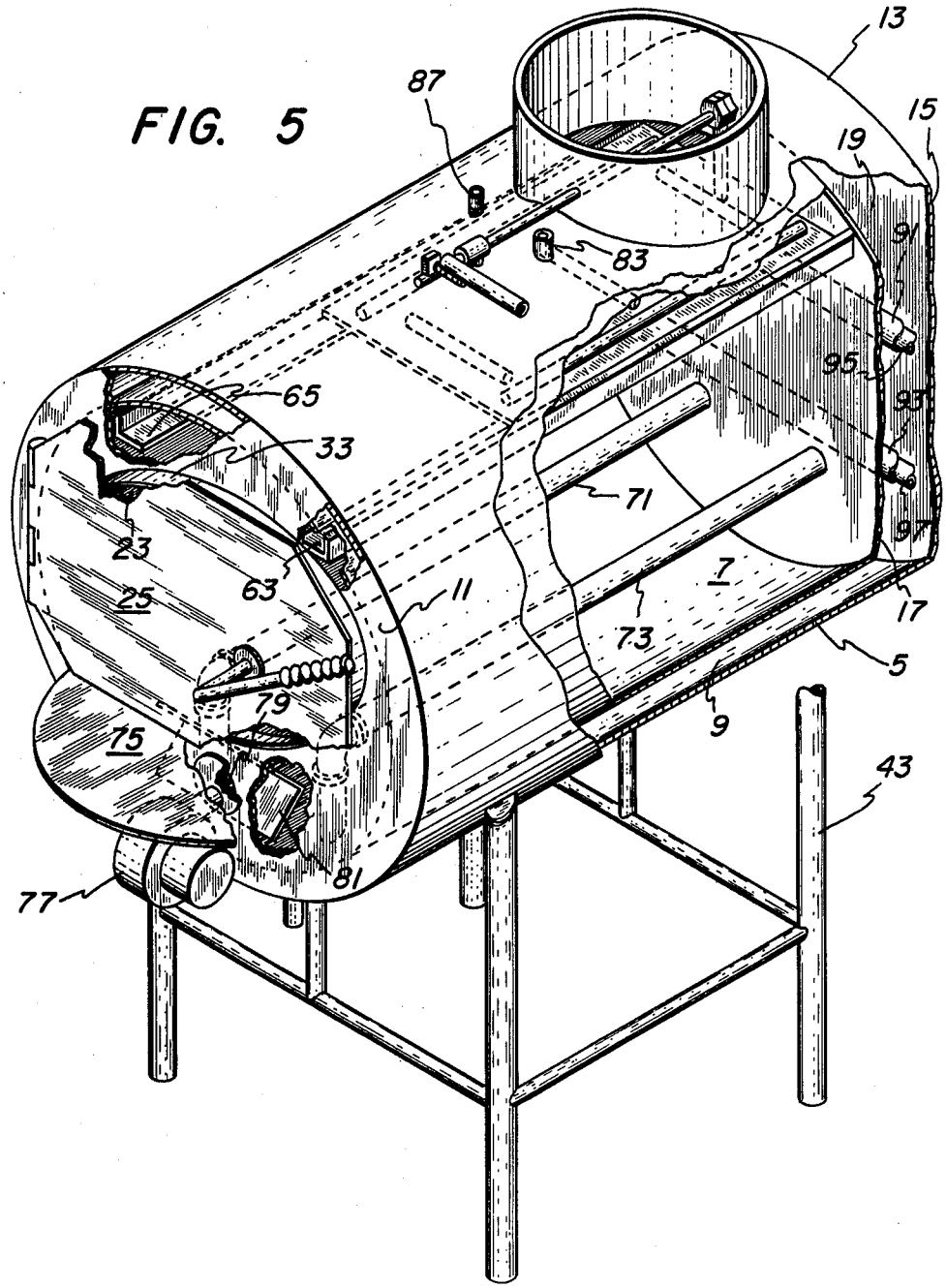
FIG. 5 is an isometric view of the invention showing the position of the secondary damper system means and the interior of the combustion chamber.

To facilitate the understanding of the invention, a nomenclature list is herewith provided:

1: generally refers to the invention
3: main body
5: outer cylindrical wall of main body 3
7: inner cylindrical wall of main body 3
9: main water jacket or boiler chamber defined by walls 5 and 7

11: front wall
13: rear wall
15: outer rear wall
17: inner rear wall
19: rear wall jacket or boiler chamber defined by walls 15 and 17
21: combustion chamber defined by inner wall 7, front wall 11 and inner rear wall 17
23: oval opening in front wall 11
25: front door or feed door
27: oval steel band on feed door 25
29: oval steel band on feed door 25
31: asbestos sealing rope between bands 27 and 29
33: steel band projecting from oval opening 23
35: latch
37: handle
39: upper stop on feed door 25
41: lower stop on feed door 25
43: vertical mounting leg
45: handle welded to stud 47
47: threaded stud threaded into nut 49
49: nut welded to extension arm 51
51: extension arm freely received in guide 53
53: horizontal extension arm guide freely receiving extension arm 51 and welded to flue 55
55: smoke collar or flue
57: lock nut engaged by threaded end of arm 51
59: depending vertical leg welded to nut 57 and damper plate 61
61: damper plate rectilinearly tracked on angle irons 63 and 65
63: horizontally disposed angle iron
65: horizontally disposed angle iron
67: lengthwise reinforcing rod welded to damper plate 61
69: widthwise reinforcing rod welded to damper plate 61
71: black iron pipe grate
73: black iron pipe grate
75: horizontally disposed fan protection plate welded to front wall 11
77: electrically operated fan
79: fan opening front wall 11
81: angle iron welded to inside of front wall 11
83: aquastat Tee coupling
85: pressure relief valve coupling
87: temperature pressure gauge nipple
89: bottom fitting
91: sleeve through rear boiler chamber 19
93: sleeve through rear boiler chamber 19
95: pipe through sleeve 91
97: pipe through sleeve 93
99: generally refers to forced, hot-air furnace
101: collar
103: blower fan
105: firebrick
107: generally refers to radiant heater
109: controllable damper in feed door 25
111: firebrick
113: bottom horizontal leg edge portion of angle iron 63
115: bottom horizontal leg edge portion of angle iron 65
117: front trailing edge of damper plate 61

In FIG. 1 of the drawings, reference numeral 1 generally refers to the wet-based, wood-burning boiler of this invention. The material choice for this invention is steel.

Boiler 1 is of closed clyindrical construction defined by a main body 3 of double-walled construction, i.e., an outer cylindrical wall 5 in spaced relationship from an inner cylindrical wall 7 together defining a main water jacket or boiler chamber 9. The main body 3 is closed by a front wall of single-wall construction, and a rear wall 13 of double-walled construction, i.e., an outer rear wall 15 in spaced relationship from an inner rear wall 17 together defining a rear water jacket or boiler chamber 19 in communication with main boiler chamber 9. Inner cylindrical wall 7, front wall 11 and inner rear wall 17 define the combustion chamber 21.

Access to the combustion chamber 21 is provied by an oval opening 23 in front wall 11 that is closed by a piano-hinged front door or feed door 25. Feed door 25 is structurally reinforced by two oval steel bands 27 and 29 in spaced relationship from each other and which together mount therebetween an asbestos sealing rope 31. Projecting outwardly from and in transverse relationship to oval opening 23 is a front-wall steel band 33. When the feed door 25 is closed, the front-wall steel band 33 is received between and partially within the two oval steel bands 27 and 29 on the feed door 25, and steel band 33 abuts against such asbestos sealing rope 31 to provide an air-tight seal. A conventional latch 35 is pivotally operable by a handle 37 between unlock and secure positions represented by projecting upper and lower abutment stops 39 and 41, respectively, to unlock and secure feed door 25 with respect to front wall 11.

The length of the vertical mounting legs 43 that are utilized allows the boiler 1 to be mounted at a height convenient for the human operator for loading a charge of wood or removing ashes.

A handle 45 is welded to a threaded stud 47 that is threaded into a nut 49 welded to an extension arm 51 that is freely received in a horizontal extension arm guide 53 welded to and communicating with a smoke collar or flue 55. The extension arm 51 projects through smoke collar or flue 55 and has a threaded end that is engaged with a lock nut 57 welded to a depending vertical leg 59 welded to a damper plate 61 freely carried upon and tracked on two parallel, horizontally disposed angle irons 63 and 65 welded to the interior of and the full length of inner cylindrical wall 7 of main body 3. Welded to damper plate 61 to provide structural reinforcing thereto and thereby are lengthwise and widthwise steel rods 67 and 69, respectively.

The grates are defined by black iron pipes 71 and 73 which communicate with the main water jacket or boiler chamber 9 and the rear water jacket or boiler chamber 19. Such pipes 71 and 73 are welded to and rise vertically from inner cylindrical wall 7 of main body 3 and extend horizontally on a gradual rise to the inner rear wall 17 to which they are welded.

A horizontally disposed fan protection plate 75 is welded to front wall 11. An electrically operated fan 77 is mounted below plate 75 and its blower end projects through an opening 79 in the front wall 11 and into the combustion chamber 21. Such opening 79 for the fan 77 is protected from damage by an angle iron 81 welded to the inside of front wall 11. When operating, fan 77 accelerates combustion and effects a faster recovery rate in heating the water in the boiler. Forced air from fan 77 follows the iron pipes 71 and 73 to effect complete combustion of the wood.

Vertically upstanding from outer cylindrical wall 5 of main body 3 and communicating with the main boiler chamber 9 are the aquastat Tee coupling 83, pressure relief valve coupling 85 and temperature-pressure gauge nipple 87.

Connected to coupling 83 is the lower run opening of a Tee fitting (not shown) whose outlet opening communicates with and joins the system flow of the heated water of the existing boiler (not shown) and whose upper run opening mounts a multiple aquastat (not shown).

Connected to coupling 85 is a water pressure relief valve (not shown) to relieve excessive pressure in the boiler chamber resulting from thermal expansion of the water in the heating system. Such relief valve is factory set to open as pressure rises above 30 psi. Upon such opening, water escapes until the pressure returns to less than 30 psi at which time the relief valve automatically resets itself and closes.

Connected to nipple 87 is a temperature-pressure gauge to provide a visual indication of the temperature and pressure of the water in the boiler chamber.

The cold water of the hot-water heating system that flows to the existing boiler (not shown) is T-connected to also flow to the bottom fitting 89 depending from outer cylindrical wall 5 and communicating with main boiler chamber 9. Such cold water is heated in the wood-burning boiler 1 and flows out through the outlet opening of such Tee fitting connected to coupling 83 and joins the system flow of the heated water of such existing boiler (not shown).

Such multiple aquastat has a low-limit switch wired to the electrically operated fan 77 such that when the temperature of the water in the wood-burning boiler 1 fa11s below 140° F., such low-limit switch is closed to complete the circuit to fan 77 to thereby operate fan 77 to accelerate combustion and effect a faster recovery rate in heating the water. When the temperature of the water in the wood-burning boiler 1 reaches 180° F., or some other temperature setting, the low-limit switch opens breaking the circuit to fan 77 thereby turning off fan 77.

Such multiple aquastat also has a high-limit switch wired to by-pass the hot-water heating system thermostat for such existing boiler (not shown) to directly run the circulator of the hot-water heating system. When the temperature of the water in the wood-burning boiler 1 reaches a high limit, such as 200° F., such high-limit switch closes to complete the circuit directly to such circulator of the hot-water heating system to thereby operate the circulator to pump water through the radiators of the hot-water heating system for the length of time that is necessary to lower the temperature of the water in the wood-burning boiler 1 below such pre-set high limit whereupon the high-limit switch is opened breaking the circuit such circulator and turning off such circulator.

Figure 8:
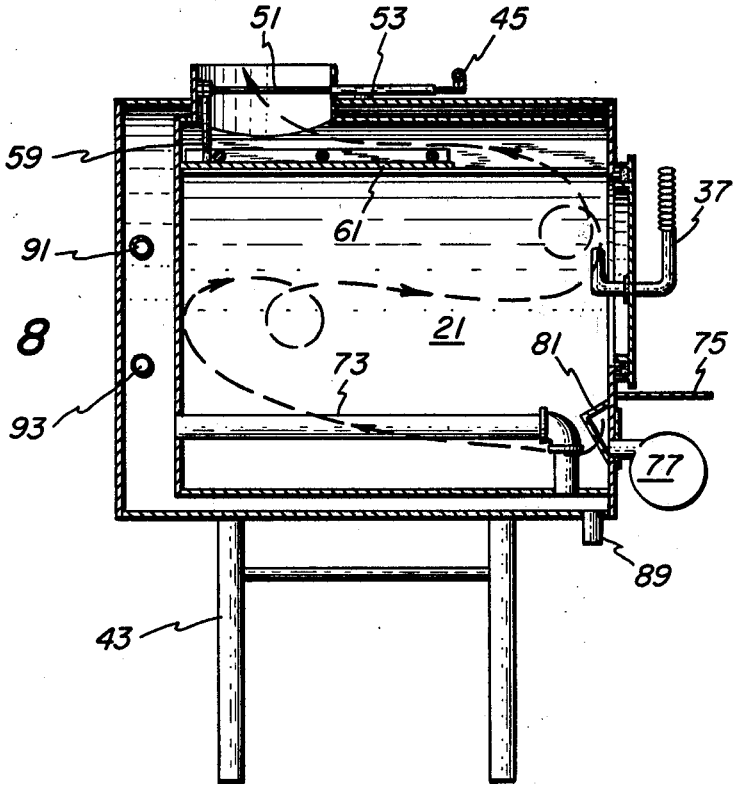
FIG. 8 is a side elevation cross-sectonal view of the boiler showing the indirect serpentine path taken by the smoke, flue gases and products of combustion when such tracked damper plate is in its closed position.

When there is a fire burning in the combustion chamber 21 of boiler 1, the damper plate 61 is rectilinearly reciprocated to its most rearward or closed position, as shown in FIGS. 1, 5, 6 and 8. In such most rearward position, heat and products of combustion from the burning wood, which are directed to the rear of boiler 1 and against the inner rear wall 17, cannot exit directly up the smoke collar or flue 55 and thence through the smokepipe (not shown) which interconnects flue 55 with the thimble in the chimney (not shown). Instead, the highest temperature possible up to 2,000° F., or more, is retained in the combustion chamber 21 because such heat and products of combustion take a serpentine path, as shown in FIG. 8, first beneath damper plate 61 to the front of boiler 1 and then the path takes a 180° curve in a reverse direction over the top side of damper plate 61 and then out flue 55. The damper plate 61 and the tracks or angle irons 63 and 65 upon which damper plate 61 rests serve to trap and transfer heat to the main and rear water jackets 9 and 19 thereby heating the boiler more quickly with a faster recovery rate.

Figure 7:
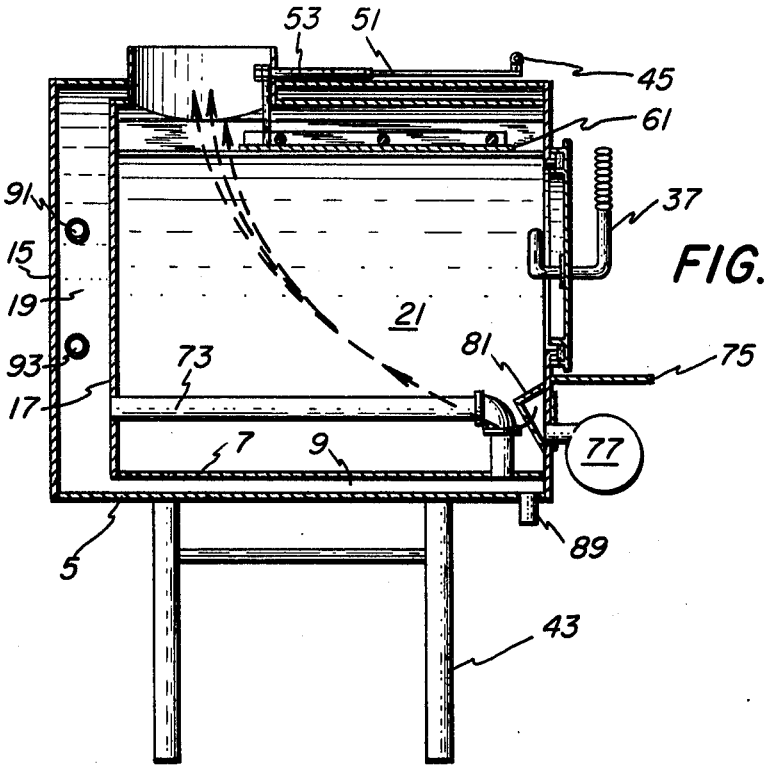
FIG. 7 is a side elevation cross-sectional view of the boiler showing the direct path taken by the smoke, flue gases and products of combustion exhausting to the boiler flue when the tracked damper plate of the secondary damper system means is in its open position.

When there is a fire burning in the combustion chamber 21 and it is desired to load such combustion chamber 21 with a charge of wood, the damper plate 61 is rectilinearly reciprocated to its most forward or open position, as shown in FIG. 7. Feed door 25 is opened and a charge of wood is appropriately disposed and positioned on the grates defined by pipes 71 and 73. The combination of the feed door 25 being opened and damper plate 61 being in its most forward or open position causes an intense build-up of heat to rise within the combustion chamber 21 straight up through the large flue 55, through the interconnecting smokepipe and through the chimney thimble to the very top of the chimney thereby burning up and off any accumulations of creosote.

Flue 55 is 10" in diameter and is considerably larger than conventional boiler flues. The purpose of flue 55 is to serve as a connecting point between the boiler 1 and the outside chimney. Flue 55 is also the focal point in conjunction with the secondary damper system structurally embodied in damper plate 61 rectilinearly reciprocable on its tracks or horizontally disposed angle irons 63 and 65.

When damper plate 61 is in its most rearward or closed position, the larger diameter of flue 55 (compared to the smaller size diameter flue utilized in the prior art) allows for movement of a greater volume of air which causes a faster recovery rate when a change in the temperature of the water in the boiler 1 is needed. The location and larger diameter of flue 55 reduces the amount of creosote build-up and serves as an exit for some of the ashes when fan 77 is operating.

Since the feed door 25 is opened and damper plate 61 is disposed in its most forward or open position when the fire is being stoked or ashes are being removed, and since a charge of wood is loaded upon the grates every day or more frequently with the feed door 25 being open and damper plate 61 being in its open position, the frequency of cleaning creosote from the chimney is kept to a minimum because of the automatic cleaning operation resulting every time the feed door 25 is open and damper plate 61 is in its open position.

The modifiable length of the vertical mounting legs 43, in addition to allowing the boiler 1 to be mounted at a height convenient for removing ashes or loading a charge of wood, allows the smokepipe to be adapted from the boiler flue 55 to a pre-existing thimble opening in the chimney without changing the location of such thimble opening thereby utilizing a minimum amount of smokepipe, 10 feet or less, allowing for the 2,000° F. temperature to rise to a greater height inside the walls of the chimney, and results in less creosote formation and build-up from the combustion chamber 21 to the boiler flue 55 through the smokepipe and to the top opening of the chimney. Such short run of smokepipe radiates less heat and at the same time will not cool the flue gases to result in creosote formation, or the resulting creosote formation will be significantly reduced. With the temperature of the flue gases and products of combustion exiting from the top opening of the chimney being maintained above the 270° deposition temperature, very little, if any, creosote will be formed while damper plate 61 is in its most rearward or closed position. And any creosote that may be formed in the smokepipe or chimney will be burned off each time the feed door 25 is opened and damper plate 61 is disposed in its open position.

The length of the legs 43 allows the oval door opening 23 to be located at a more convenient height for the human operator, approximately 34" centered from the bottom of the oval door or feeder opening 23 to the floor. Such location of the feed door 25 allows for more convenient interior inspection prior to removing ashes or loading a charge of wood.

The overall outside diameter of 29½" of the main body 3 makes for ease in transporting the boiler 1 through an ordinary 30" door opening.

The overall length of the outside of the boiler 1 is ordinarily 34" long with a 30" length firebox or combustion chamber 21. The reason for such 30" length firebox 21 is that it allows the human operator, when cutting his wood, to order a standard cord of wood, 4' high, 8' long and 4' across allowing for one cut making two pieces 24" long.

Steel is the only material used in the construction of the wood-burning boiler 1. Steel is used because it can be easily repaired with a gas torch or welder. The boiler 1 is also constructed without square corners. The round configurations used throughout the wood-burning boiler 1, especially areas exposed to extreme heat as high as 2,000° F., or more, are used to add strength and to eliminate warping.

The inner rear wall 17 is constructed of ¼" thick steel while the inner cylindrical wall 7 is 0.281" thick steel. The front wall 11 does not receive the 2,000° F. or more of direct heat. The front part of the boiler 1 is where the natural or forced draft make-up air comes from forcing the heat up and towards the back of the firebox or combustion chamber 21 at all times. Because of a lower heat range, it is feasible to construct the feed door 25 of 3/16" steel which is reinforced on the inner fireside by the oval steel bands 27 and 29. Such bands 27 and 29, ⅛" thick, 1" across, and 1" apart are also used to hold the 1" diameter door seal in place. Such door seal is in the form of the asbestos sealing rope 31.

The outer cylindrical wall 5 is constructed of 10 gauge steel approximately ⅛" thick. The average pressure of a wood-burning boiler ranges from only 12 to 20 lbs. The outer rear wall 15 is constructed 3/16" steel.

The composition of such secondary damper system is as follows: each of the two horizontally disposed angle irons 63 and 63 is 2"×2"×⅜". The angle irons 63 and 65 are spot-welded the full length of the combustion chamber 21, offset to each side and leveled at the opening of the flue 55 at 13" (outside diameter) apart. The damper plate 61 is ¼" thick steel ×10½" wide×20" long. This makes damper plate 61, 10" shorter than the entire length of the combustion chamber 21. The reinforcing rods 67 and 69 are ½" solid steel. The depending vertical leg 59 is a ¾" solid steel rod, 5½" long, that has one end welded vertically to the black portion of damper plate 61. The vertical leg 59 extends through the flue 55 and has the ½" coarse threaded lock nut 57 welded vertically on the other end of vertical leg 59. The extension arm 51 is a ½" solid steel rod, 20" long, that has a threaded end engaged with the lock nut 57. The extension arm 51 extends horizontally through the ½" inside diameter of the horizontal extension arm guide 53 that is 8" long and has one end that is welded to and communicates with the smoke collar of flue 55. The other end of the extension arm 51 is welded to the ⅜" coarse nut 49. The threaded stud 47 that has one end threaded into nut 49 is ⅜" diameter and 1" long and has its other end welded to the handle 45 made of ½" inside diameter steel pipe 5" long.

The 10" outside diameter smoke collar or flue 55 is ¼" thick and is located on the top of the outer cylindrical wall 5 approximately 5" forward from the outer rear wall 15.

The grates are two schedule 80, high temperature, high pressure, 1¼" inside diameter, black iron pipes 71 and 73 that are welded to, rise up from the inner cylindrical wall 7 and communicate with main boiler chamber 9 approximately 3" from the front wall 11. Pipes 71 and 73 extend on a gradual rise to, are welded to inner rear wall 17 and communicate with the rear water jacket or boiler chamber 19. The pipes 71 and 73 are positioned in the area where the highest temperatures are produced from combustion. The pipes 71 and 73 are offset from the center, 9" from the bottom of the inner cylindrical wall 7 running horizontally from front to back, and the curvature of the bottom of the inner cylindrical wall 7 makes a natural ashpit for the finest ashes which makes for the easiest method of removing ashes with a coal shovel.

The installation of conventional grates has a tendency to keep a large portion of hot coals away from the surface that is being heated. The installation of conventional grates reduces the available area to be heated by the coals, thereby reducing the effectiveness of the boiler. Conventional grates interfere with the complete burning of the wood fuel by allowing large chunks of unburned wood to drop through the grates to the bottom of the stove into the ash pan where burning is incomplete. This requires more wood to be burned with unburned coals to be removed more frequently. This is both wasteful and expensive.

The outer cylindrical wall 5 is spaced apart approximately 1.5" from the inner cylindrical wall 7. The outer rear wall 15 is spaced apart 4" from the inner rear wall 17. Hence, the outer cylindrical wall 5 and inner cylindrical wall 7, by their construction, surround the smoke collar or flue 55 with 1.5" of water. The greatest area of heating, the combustion chamber 21, is surrounded by water which results in a maximum amount of BTU's being converted to useable heat. This is evidenced by the fact that there is a minimum amount of heat given off by the wood-burning boiler 1 and interconnecting smokepipe while operating at its capacity.

The electrically operated fan 77 is 1/25 horsepower and produces 60 CFM at free air. The opening 79 in front wall 11 for the projection by the fan 77 into the combustion chamber 21 is protected by the angle iron 81 which is a piece of steel angle iron 3½"×2½"×¼" thick welded to the inside of front wall 11.

The length of the combustion chamber 21 is 30" long which allows for one cut in the center of a 48" long log. The combustion chamber 21 is approximately 25" in diameter. The large combustion chamber 21 eliminates the inconvenience of the frequent stoking necessary in most other modern furnaces.

The fan protection plate 75 is 20" long and 7" wide at its widest point, is a semi-round 3/16" thick steel plate welded horizontally to the front wall 11 below the feed door 25 and serves to protect the blower located directly below it from debris falling into the fan 77. The oval opening 23 in front wall 11 is 14"×20" and facilitates the loading of a charge of wood into and removing ashes from boiler 1.

Disposed horizontally through the rear water jacket or boiler chamber 19 are sleeves 91 and 93 which are welded to outer cylindrical wall 5 and mount therethrough pipes 95 and 97 connected with the domestic hot water heater.

Figure 9:
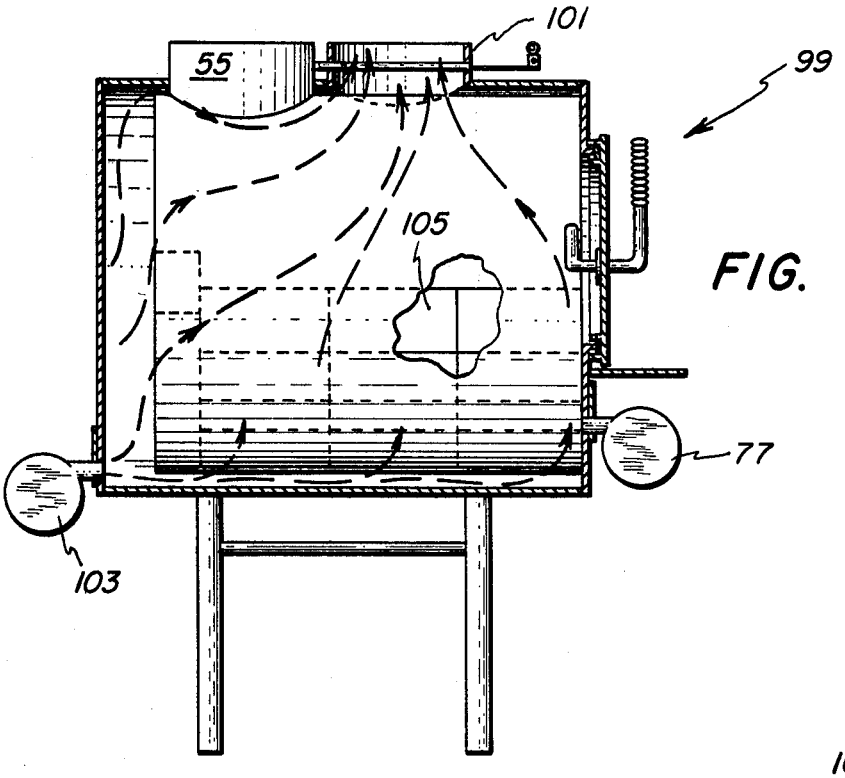
FIG. 9 is a side elevation cross-sectional view showing the wet-based, wood-burning boiler modified to function as a wood-burning, forced, hot-air furnace.

In FIG. 9 of the drawings, reference numeral 99 generally refers to the boiler that has been modified to function as a forced, hot-air furnace. The following changes in structure are made in the wet-based, wood-burning boiler 1 to convert same to the forced, hot-air furnace 99, to wit:

(a) the black iron pipes 71 and 73 are removed;
(b) the sleeves 91 and 93 are removed;
(c) the main boiler chamber 9 and rear boiler chamber 19 function as a plenum chamber, and a collar 101 is welded to outer cylindrical wall 5 and communicates with main boiler chamber 9;
(d) the horizontal extension arm guide 53 is further extended to extend through the collar 101;
(e) a thermostat-responsive, electrically operated fan 103 is projected through outer rear wall 15 to force air through the boiler chambers 9 and 19, and out through collar 101;
(f) the combustion chamber 21 is lined with firebrick 105. A leader (not shown) is connected to collar 101 to conduct to the rooms forced hot air heated in the plenum chamber defined by main boiler chamber 9 and rear boiler chamber 19.

Figure 10:
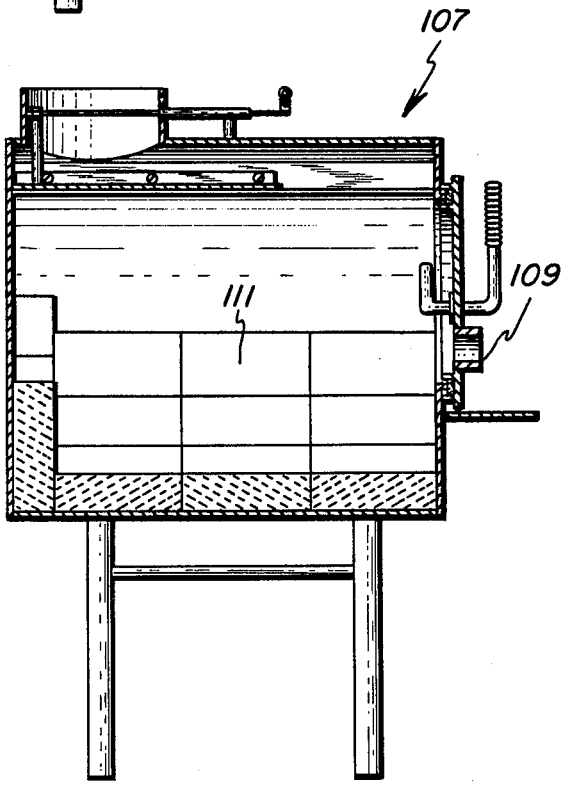
FIG. 10 is a side elevation, cross-sectional view showing the wet-based, wood-burning boiler modified to function as a wood-burning, radiant heater.

In FIG. 10 of the drawings, reference numeral 107 generally refers to the boiler that has been modified to function as a radiant heater. The following changes in structure are made in the wet-based, wood-burning boiler 1 to convert same to the radiant heat 107, to wit:

(a) outer cylindrical wall 7 is removed;
(b) outer rear wall 15 is removed;
(c) black iron pipes 71 and 73 are removed;
(d) fan 77 and angle iron 81 are moved;
(e) sleeves 91 and 93 are removed;
(f) a controllable, fresh-air, draft damper 109 is incorporated in the feed door 25;
(g) the combustion chamber 21 is lined with firebrick 111.

The fresh-air, draft damper 109 is opened or closed by manually unscrewing same in one direction or tightening same in the opposite direction thereby opening or closing conventional draft ports (not shown) which effect communication of fresh air from the outside with the inside of the firebox or combustion chamber 21.

Like the wet-based, wood-burning boiler 1, both the forced, hot-air furnace 99 and the radiant heater 107 similarly function to retain in their respective combustion chambers the highest temperature possible up to 2,000° F., or more. Similarly, with the damper plate 61 in its closed position, smoke, flue gases and products of combustion are forced to take and follow the serpentine path, as shown in FIG. 8, with the damper plate 61 and tracks 63 and 65 serving to trap and transfer heat. And since such combustion chamber retains such high temperature, the temperature of the flue gases and products of combustion exiting from the top opening of the chimney will be maintained above the 270° F. critical deposition temperature for creosote.

The hot-air furnace 99 and radiant heater 107 similarly function when their feed doors 25 are open and their damper plates 61 are in open position to cause an intense build-up of heat to rise within their combustion chambers 21 straight up through the large flues 55, through their interconnecting smokepipes and through their chimney thimbles to the very tops of the chimneys thereby burning up and burning off any accumulations of creosote.

When damper plate 61 is in its closed position, there remains 110 square inches of open space area perimetered and defined by the front wall 11, the bottom horizontal leg edge portions 113 and 115 of respective angle irons 63 and 65, and the front trailing edge 117 of the damper plate 61 through which the smoke, flue gases and products of combustion can and do stream and thence exit and exhaust through flue 55 compared to the approximate 78 square inches of area provided by flue 55. This means that although the boiler 1 is structurally designed to retain the highest temperature possible of heat in the combustion chamber 21 when damper plate 61 is in its closed position, nevertheless, the 110 square inches of open space provided by front wall 11, leg edge portions 113 and 115, and the front trailing edge 117, provide at least 14% more effective draft than that which is provided by flue 55 and its 78 square inches, and hence the flue gases will not cool to the 270° F. creosote deposition temperature because not only does the large 10" diameter of flue 55, per se, provide greater draft and allow for movement of a greater volume of air, but the 14% more effective draft area defined by damper plate 61 in its closed position provides still greater draft than the flue 55. While heat is being retained in the combustion chamber 21, still the smoke, flue gases and products of combustion are not allowed to linger and cool down to the critical creosote deposition temperature.

Having thus described my invention, I claim:

1. A wood-burning device comprising a combustion chamber, flue means and secondary damper system means; said combustion chamber having a main body cylindrical wall, a front wall and a rear wall, said combustion chamber burning wood therein, said flue means being in the top portion of said main body cylindrical wall and adjacent said rear wall, said secondary damper system means being reciprocable to an open position and a closed position, said secondary damper system means in its said open position non-interferingly allowing smoke, flue gases and products of combustion to exhaust directly through said flue means, said flue means being of sufficient size to provide draft to exhaust non-interferingly and directly from said combustion chamber the smoke, flue gases and products of combustion when said secondary damper system means is in its said open position, said secondary damper systom means in its said closed position indirectly exhausting to said flue means the smoke, flue gases and products of combustion, said secondary damper system means having a damper plate and two angle irons, said damper plate being flat and of rectangular configuration, said damper plate having a top side, a bottom side, a front edge, a rear edge and lateral sides, said main body cylindrical wall having an inner wall fixedly carrying said two angle irons the full length of said inner cylindrical wall, said two angle irons being horizontally disposed and in parallel relationship with each other, said two angle irons freely carrying and tracking thereon said lateral sides of said damper plate in sealing relationship therewith, in said open position of said secondary damper system means said front edge of said damper plate being engaged in sealing relationship with said inner front wall of said combustion chamber, in said closed position of said secondary damper system means said rear edge of said damper plate being engaged in sealing relationship with said inner rear wall of said combustion chamber, said open position of said secondary damper system means providing a draft area defined by said rear edge of said damper plate, said inner rear wall of said combustion chamber and said angle irons, said closed position of said secondary damper system means providing a draft area defined by said front edge of said damper plate, said inner front wall of said combustion chamber and said angle irons, said draft areas in said open and closed positions of said secondary damper system means being equal, said draft area in said closed position of said secondary damper system means being greater than, and thereby more effective than, the draft area of said flue means, said secondary damper system means in its said closed position forcing the heat, smoke, flue gases and products of combustion to take a serpentine path first beneath said damper plate towards the front of said heating device and then a 180° curved path in a reverse direction over said top side of said damper plate and then out said flue means with said damper plate and angle irons thereby serving to trap and transfer the greatest amount of heat while maintaining the temperature of the exhausting flue gases above the critical creosote deposition temperature.

2. A wood-burning heating device in accordance with claim 1, wherein said heating device has a feed door and wherein said front wall has an oval opening providing access to said combustion chamber, said feed door closing said oval opening in said front wall.

3. A wood-burning device in accordance with claim 1, wherein are further provided an outer cylindrical wall and an outer rear wall, and wherein said heating device has a plenum chamber defined by said outer cylindrical wall being in spaced relationship from said main body cylindrical wall and said outer rear wall being in spaced relationship from said rear wall.

4. A wood-burning device in accordance with claim 3, wherein said heating device has a collar and fan, said collar communicating with said plenum chamber and said fan being operatively connected with said plenum chamber to force air through said plenum chamber and out said collar.

5. A wood-burning device in accordance with claim 1, wherein said heating device is a wet-based, wood-burning boiler, said wet-based boiler having an outer cylindrical wall in spaced relationship from said main body cylindrical wall and together defining a main boiler chamber, said wet-based boiler having an outer rear wall in spaced relationship from said rear wall and together defining a rear boiler chamber, said main boiler chamber and rear boiler chamber being in communication with each other.

6. A wood-burning device in accordance with claim 5, wherein said heating device has a feed door and wherein said front wall has an oval opening providing access to said combustion chamber, said feed door closing said oval opening in said front wall.

7. A wood-burning device in accordance with claim 5, wherein said heating device has pipes communicating with said main boiler chamber and with said rear boiler chamber, and wherein said pipes together define grates.

8. A wood-burning device in accordance with claim 7, wherein said heating device has a fan, wherein said front wall has an opening, wherein said fan projects through said front wall opening and into said combustion chamber and wherein said fan forces air to follow said pipes to accelerate combustion of wood in said combustion chamber to effect a faster recovery rate in heating water in said main boiler chamber and said rear boiler chamber.

* * * * *